US006367654B1

(12) United States Patent
Simpson

(10) Patent No.: US 6,367,654 B1
(45) Date of Patent: Apr. 9, 2002

(54) DISPENSER BOX

(75) Inventor: Raymond Simpson, Oakpark, IL (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/638,882

(22) Filed: Aug. 15, 2000

Related U.S. Application Data

(63) Continuation-in-part of application No. 09/130,445, filed on Aug. 6, 1998, now Pat. No. 6,123,221, which is a continuation-in-part of application No. 08/999,846, filed on Oct. 9, 1997, now Pat. No. 5,979,699.

(51) Int. Cl.[7] ..... B65H 1/08
(52) U.S. Cl. ..... 221/58; 206/812
(58) Field of Search ..... 221/33, 45, 46, 221/47, 48, 51, 49, 56, 58, 59; 206/556, 445, 812

(56) References Cited

U.S. PATENT DOCUMENTS

| | | | | |
|---|---|---|---|---|
| 2,027,671 | A | 1/1936 | Broeren | 312/62 |
| 2,237,424 | A | 4/1941 | Hope | 312/62 |
| 2,253,742 | A | 8/1941 | West et al. | 312/62 |
| 4,993,590 | A | 2/1991 | Windorski | 221/46 |
| 5,165,570 | A | 11/1992 | Windorski et al. | 221/46 |
| 5,363,985 | A | 11/1994 | Cornell | 221/46 |
| 5,390,820 | A | 2/1995 | Wright et al. | 221/52 |
| 5,979,699 | A | 11/1999 | Simpson | 221/52 |

FOREIGN PATENT DOCUMENTS

| | | | |
|---|---|---|---|
| EP | 0253308 | 1/1988 | 221/33 |

*Primary Examiner*—Kenneth W. Noland
(74) *Attorney, Agent, or Firm*—Quarles & Brady LLP

(57) ABSTRACT

The present invention discloses a dispenser box allowing for the removal of individual coupons without the chance of another coupon being removed at the same time. The dispenser comprises walls defining a cavity adapted to receive the stack of sheets, an opening through which the sheets may be individually dispensed, a flat bottom wall fitting within the dimensions of the four walls, and a resilient member to push the stack of sheets to the opening in the top wall of the dispenser. The device may also comprise a filler, a shouter for drawing attention to the dispenser, and a device for mounting the dispenser to a shelf.

44 Claims, 7 Drawing Sheets

DISPENSER BOX

DESCRIPTION

This application is a Continuation in Part of Ser. No. 09/130,445 filed Aug. 6, 1998 now U.S. Pat. No. 6,123.221, which is a Continuation in Part of application Ser. No. 08/999,846 filed Oct. 9, 1997, now U.S. Pat. No. 5,979,699.

BACKGROUND OF THE INVENTION

1. Field of the Invention

The present invention discloses a dispenser box allowing for the removal of individual coupons without the chance of another coupon being removed at the same time.

2. Description of the Prior Art

Over the years, there have been many dispenser boxes developed for the dispensing of sheets of paper or coupons of some sort. This type of device has become more important in the marketplace as grocery and other stores have installed coupon dispensers on their shelves to give consumers incentives to make impulse purchases based on lower prices given at their stores on any given day of the week.

To accommodate consumer needs, there have been a number of different paper dispensing devices over the years.

U.S. Pat. No. 2,253,742 (W. H. West et al.) discloses a dispenser for interfolded paper. The dispenser comprises a vertically disposed container having a dispensing opening and a spring-actuated follower plate in the container adapted to support a vertically disposed stack of interfolded paper sheets. A plate is secured to the under side of the cover at one side of the dispensing opening, and engages the upper end of the stack while maintaining a predetermined spacing between the stack and the dispensing opening. A second plate is secured to the underside of the cover, the ends of the plates adjacent the dispensing opening being rounded to form deflecting surfaces.

U.S. Pat. No. 5,390,820 (Wright et al.) discloses an elevating dispensing device for flexible sheet material. The dispensing aperture has flaps to retain the end of successively drawn sheets above the aperture for ease of withdrawal. The stack of sheets rests within the carton on an elevating platform which is flexibly attached on two opposing sides to the base of the adjacent side walls of the carton by flexibly folded extension panels which allow upward urging of the elevating platform.

U.S. Pat. No. 2,237,424 (S. N. Hope) discloses a sheet dispenser comprising a casing adapted to contain a pack of interfolded sheets and having opposite end walls with inwardly directed embossments adjacent to the opposite sides of the casing. A pair of cover members extends between the casing end walls and having end walls with outwardly directed embossments adapted to register with the casing embossments. A coiled spring for each cover member urges the cover member against the pack, with the spring surrounding a cooperating pair of the embossments on the casing and cover member.

U.S. Pat. Nos. 4,993,590 (Windorski), and U.S. Pat. No. 5,165,570 (Windorski et al.) are for dispensers for a stack of partially adhesive coated sheets stacked with the adhesive coating on each successive sheet disposed along alternate opposite sides of the stack and releasably adhering the sheets together.

In U.S. Pat. No. 4,993,590, the dispenser for adhesive coated sheets has opposed end surfaces having parallel upper ends adapted to be engaged by the opposite sides of the stack with the top sheets in the stack parallel to the adjacent upper ends, with the opposed end surfaces diverging slightly from each other toward the upper ends of the end surfaces to cause movement of the end portions of the stack along the end surfaces toward the upper ends in response to forces applied to the stack to sequentially remove sheets from the stack through the opening.

U.S. Pat. No. 5,979,699 (Simpson) discloses a dispenser box allowing for the removal of individual coupons without the chance of another coupon being removed at the same time. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

U.S. Pat. No. 6,079,190 (Simpson) discloses a method for dispensing packaged bandages in a way that allows for the easy removal of the bandage from its package. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

U.S. Pat. No. 5,848,723 (Krautsack) discloses a coupon dispenser in the form of an integral, vacuum-molded thermoplastic sheet foldable upon itself to enclose a stack of coupons in a box-like container with opposed side wall openings which allow withdrawal of coupons from both sides of the dispensing container. Integrally molded mounting accommodation is provided at one end. In an alternative form, the coupon receptacle proper is separately inserted by halves, respectively, in each foldable part.

U.S. Pat. No. 6,053,356 discloses a coupon dispenser provided with at least one suction cup and, preferably, a pair of suction cups, connected to the dispenser box so that the box can be directly mounted on a window, refrigerator/freezer door, or any other substantially flat and smooth surface capable of supporting a suction cup.

U.S. Pat. No. 5,944,219 (Emoff et al.) discloses a pop-up coupon dispenser for small sheets which have a repositionable adhesive is provided with a flexible plastic cable tie. The dispenser includes a box filled with such sheets having an adhesive stripe along one margin and stacked in accordion fashion, the sheets being printed as manufacturer's coupons supplied to a retailer who attaches the box by the cable tie to a wire rack, to a cardboard display or other suitable support, such as a shelf, and cuts off the excess end of the cable tie. Customers can remove the coupons one-at-a-time and affix them by their adhesive backing to the product for which the coupon is redeemable. A check out cashier can, therefore, immediately determine that the purchaser is purchasing the product for which the coupon was issued.

SUMMARY OF THE INVENTION

This invention is for a dispenser for flexible sheets from a stack of sheets disposed one said sheet on top of another, allowing for the dispensing of individual sheets. The proposed dispenser is more durable than previous dispensers, holds more coupons, and can be more securely mounted. The shape and size of the dispenser also make it more noticeable, and easier to display. The dispenser comprises walls defining a cavity adapted to receive the stack of said sheets, including two long flat end walls parallel to each other; each long flat end wall having the approximate same dimensions as the other flat end wall, two long flat side walls wherein edges of each of the two long flat side walls are positioned perpendicularly to edges of the length of the two long flat end walls at opposite sides of the flat top wall, wherein the two long flat side walls are parallel to each other, a flat bottom wall wherein at least one edge along the length of the flat bottom wall is affixed to the bottom of the dispenser, and wherein said flat bottom wall fits within the dimensions of the two long flat side walls and the two long flat end walls. The top section comprises an opening through which the coupons may be removed, said opening formed by opposing flaps, formed by an extension from at least one of the walls. A resilient member positioned underneath said stack of sheets and between the long flat end walls and above the bottom wall pushes the stack of sheets to the opening in the top wall of the dispenser.

The stack of sheets are positioned between the two long end walls wherein each flexible sheet from the stack of sheets is disposed one the flexible sheet on top of another the flexible sheet, each the flexible sheet being independent from one another and folded upon itself at a specific length, allowing for the dispensing of individual sheets.

In yet another embodiment of the invention, the dispenser further comprises a filler positioned between the resilient member and the bottom wall of the dispenser.

In a preferred embodiment, the dispenser is made from one said single piece of flexible material being cut to allow for folding of said material to form said dispenser. The material may be selected from the group consisting of paper, styrene, and plastic.

In yet another embodiment of the invention, there is an attachment device for attaching the dispenser to a shelf. The attachment device may be a rail clip attachment attached to the flat bottom wall of said dispenser for attachment to a rail of a shelf The rail clip attachment may comprise a flat surface for attachment to the member of the shelf sign two brackets intersecting and extending outwardly from the base member, the brackets having, at their ends, foot-like projections facing away from each other, said foot-like projections fitting into retaining rails of a shelf, at least one hole in at least one of said brackets; and a screw, the screw fitted through the hole in one of the brackets, whereupon the tightening or loosening of the screw pushes together or allows for the expansion of the two brackets, thereby allowing for a placement or removal of the device on a shelf edge.

Another embodiment of the invention calls for a shouter, comprised of a head for a display area for printed matter, and a leg, wherein one end of the leg is attached to the head, and another end of the leg is inserted into a slot in the dispenser, allowing for the display of the printed matter. The shouter further comprises a foot integrally attached to the leg at the end which is inserted into a slot in the dispenser, the foot being a tab which is turned upward, thus serving the purpose of securing the shouter to the dispenser.

This devices allows the consumer to easily remove a single coupon from the dispenser, by simply pulling the coupon on top from the dispenser.

BRIEF DESCRIPTION OF THE DRAWINGS

The invention will be better understood and further objects, characterizing features, details and advantages thereof will appear more clearly as the following description proceeds with reference to the accompanying diagrammatic drawings given by way of non limiting example only illustrating a presently preferred specific embodiment of the invention and wherein.

DESCRIPTION OF THE PREFERRED EMBODIMENT

Figure 1:
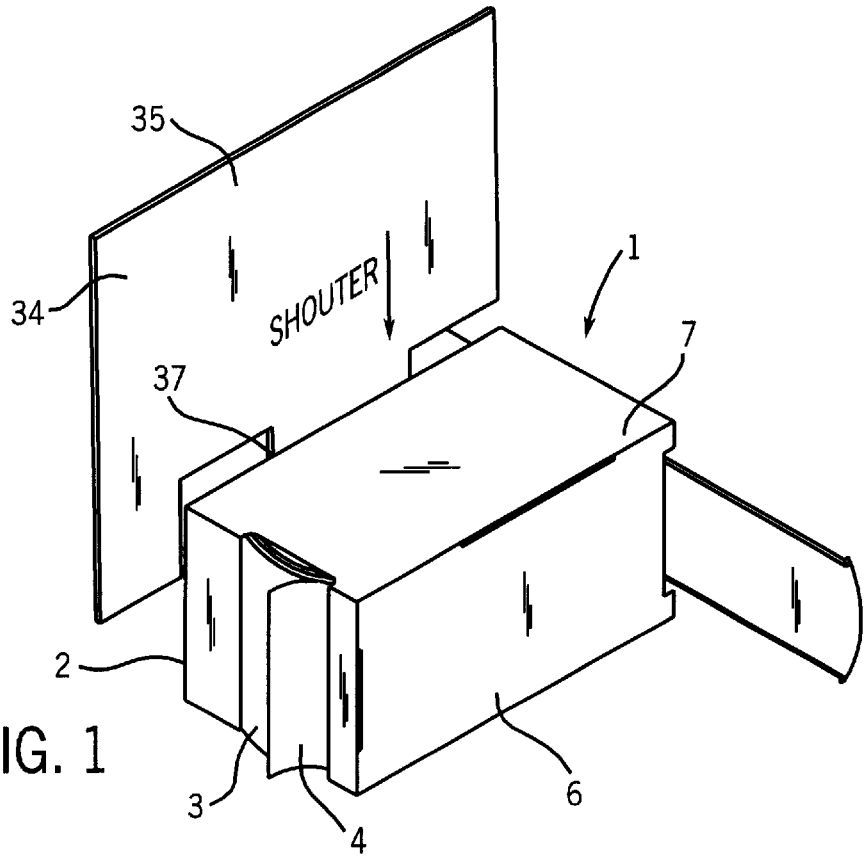
FIG. 1 is a perspective view of the coupon dispenser.
Figure 2:
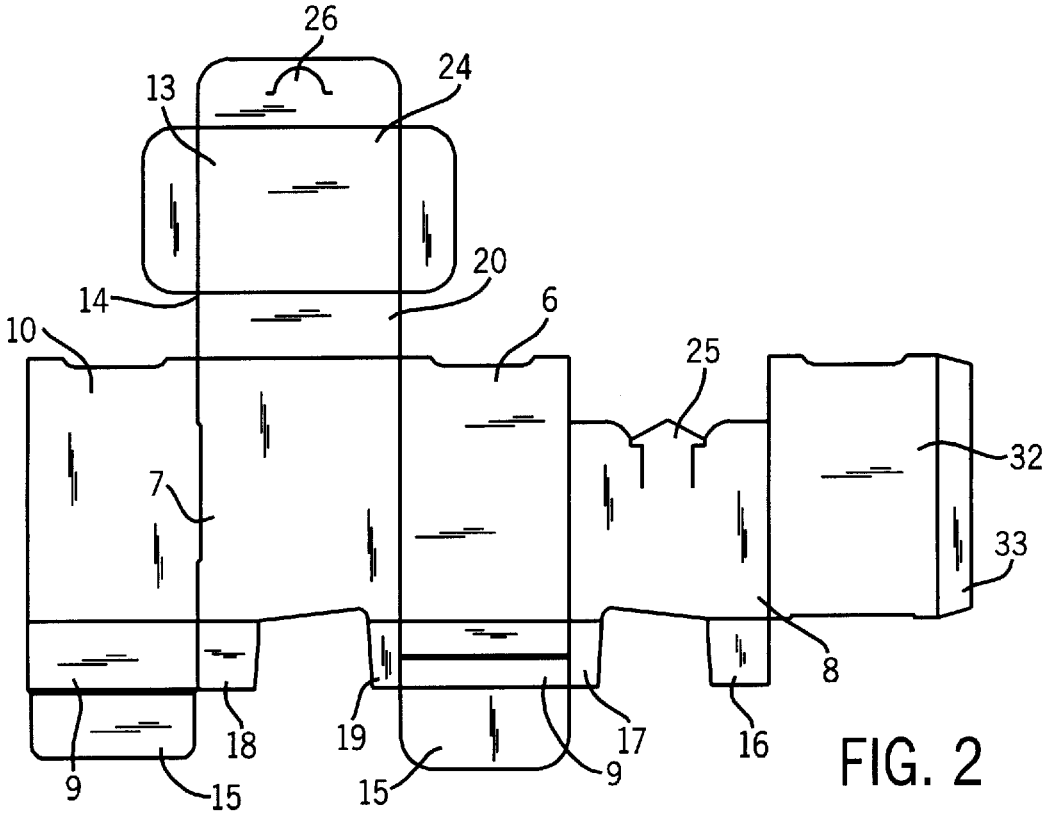
FIG. 2 is an overhead view of the unitary body of the coupon dispenser.
Figure 3:
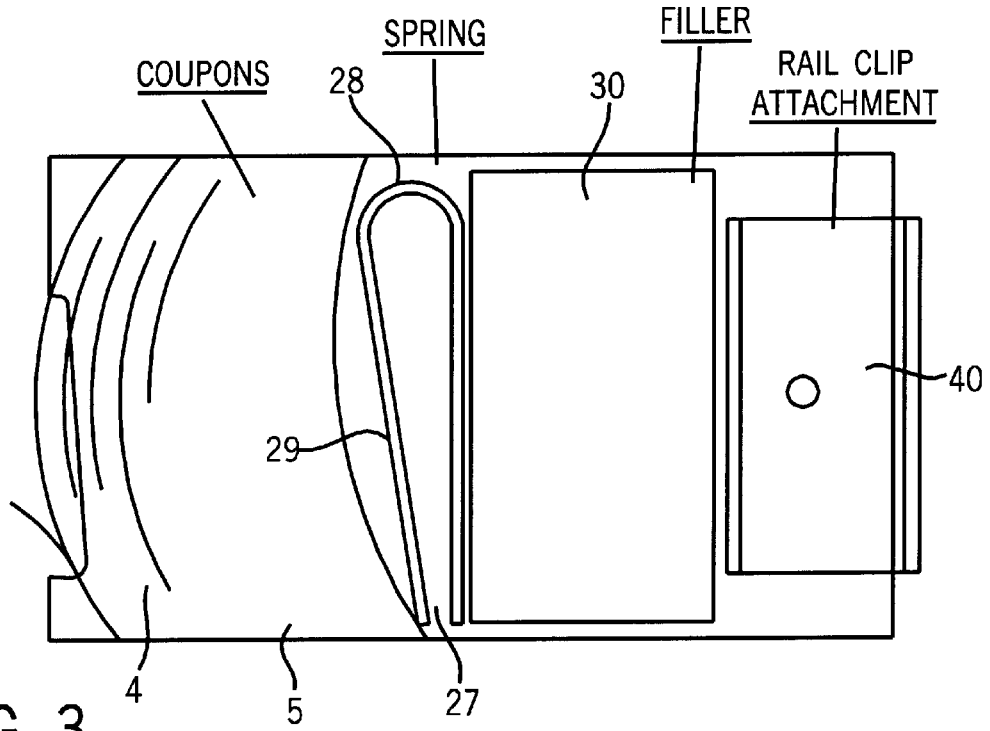
FIG. 3 is a cross-sectional view of the coupon dispenser.
Figure 4:
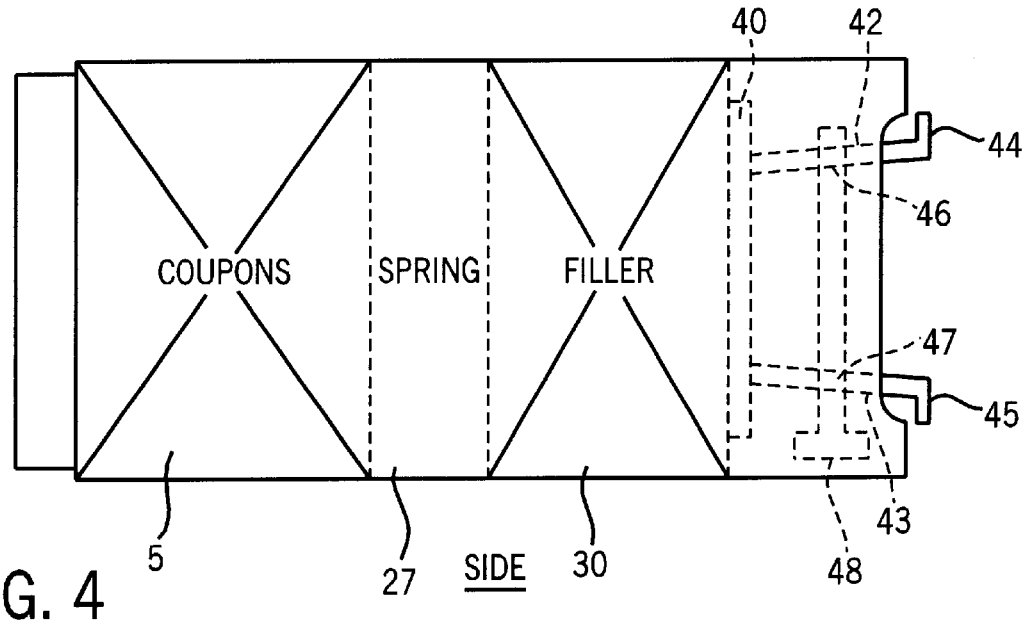
FIG. 4 is a schematic view of the coupon dispenser.
Figure 5:
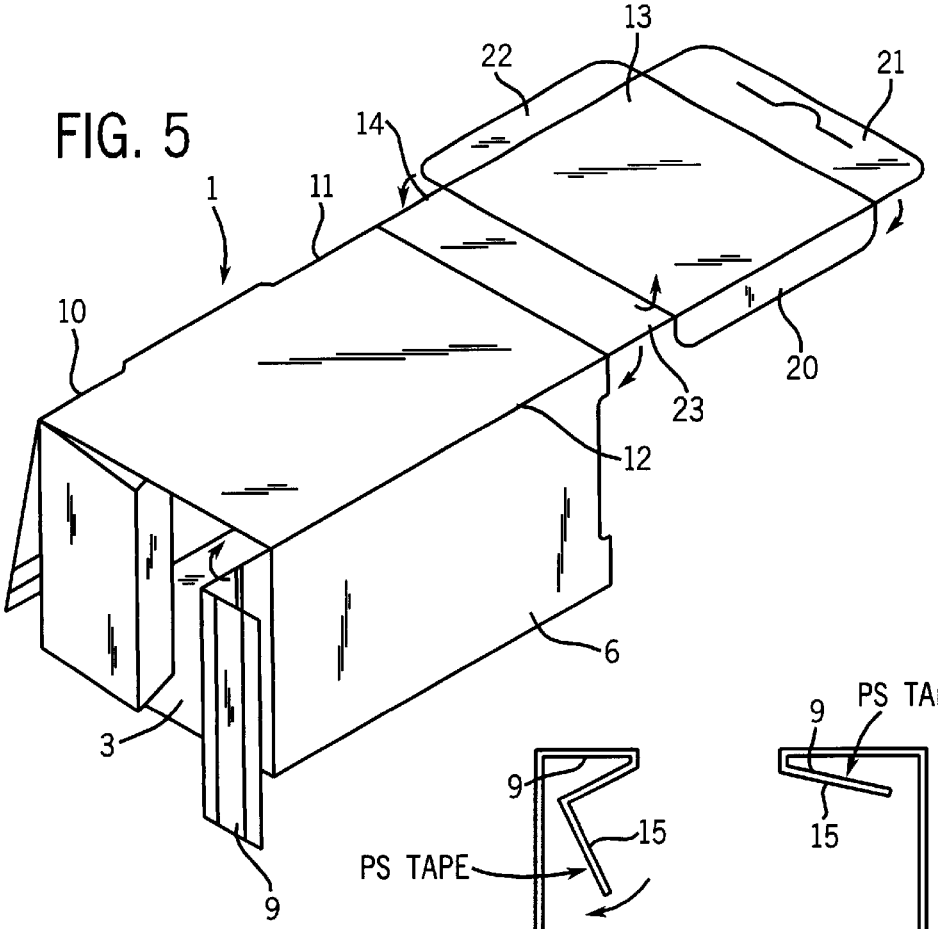
FIG. 5 is a perspective view of the coupon dispenser, showing the bottom wall in its open position.
Figure 6:
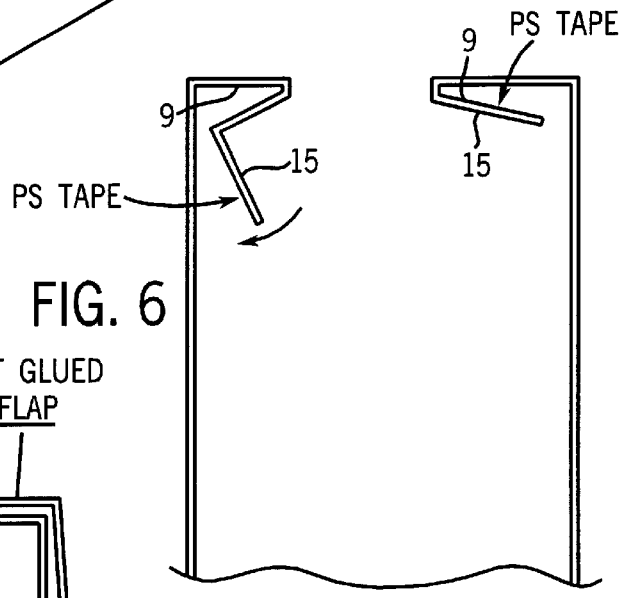
FIG. 6 is a cross sectional view showing the opening of the dispenser.
Figure 7:
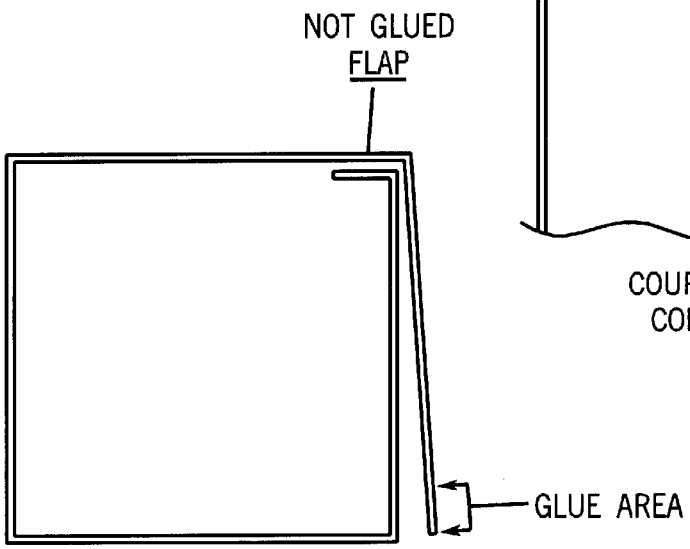
FIG. 7 is a cross sectional view from the bottom of the dispenser.
Figure 8:
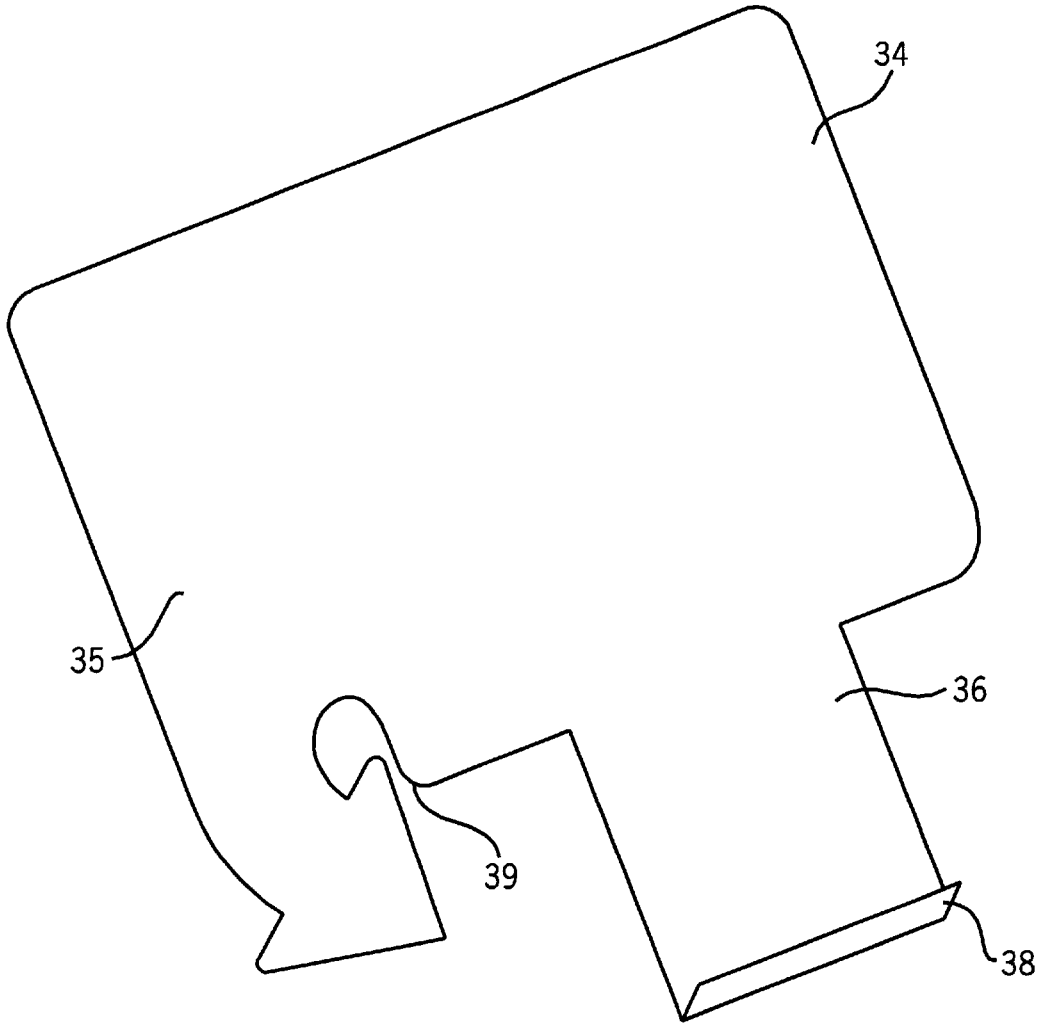
FIG. 8 is a perspective view of the advertising device of the dispenser
Figure 9:
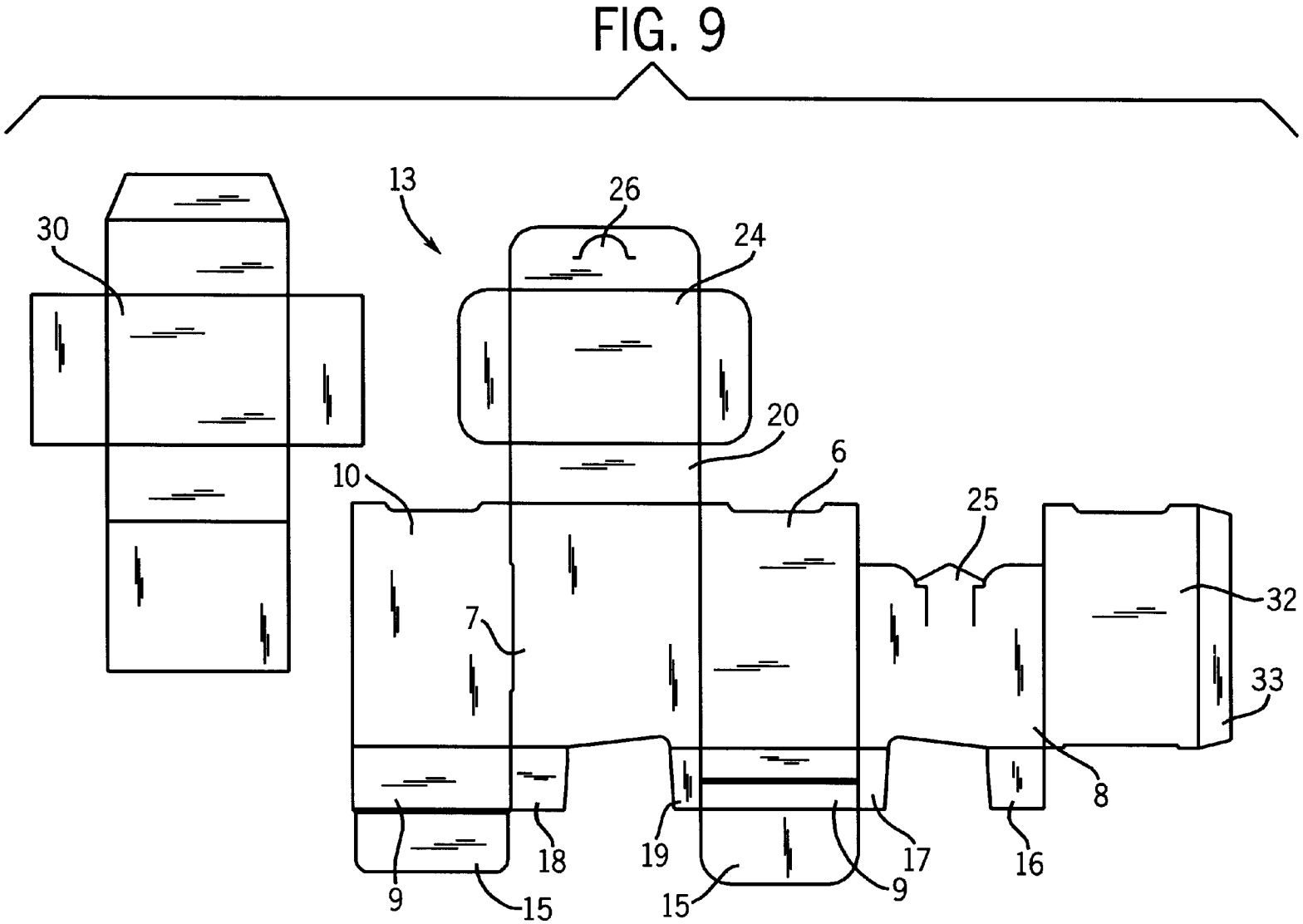
FIG. 9 is an overhead view of the unitary body, including the insert.
Figure 10:
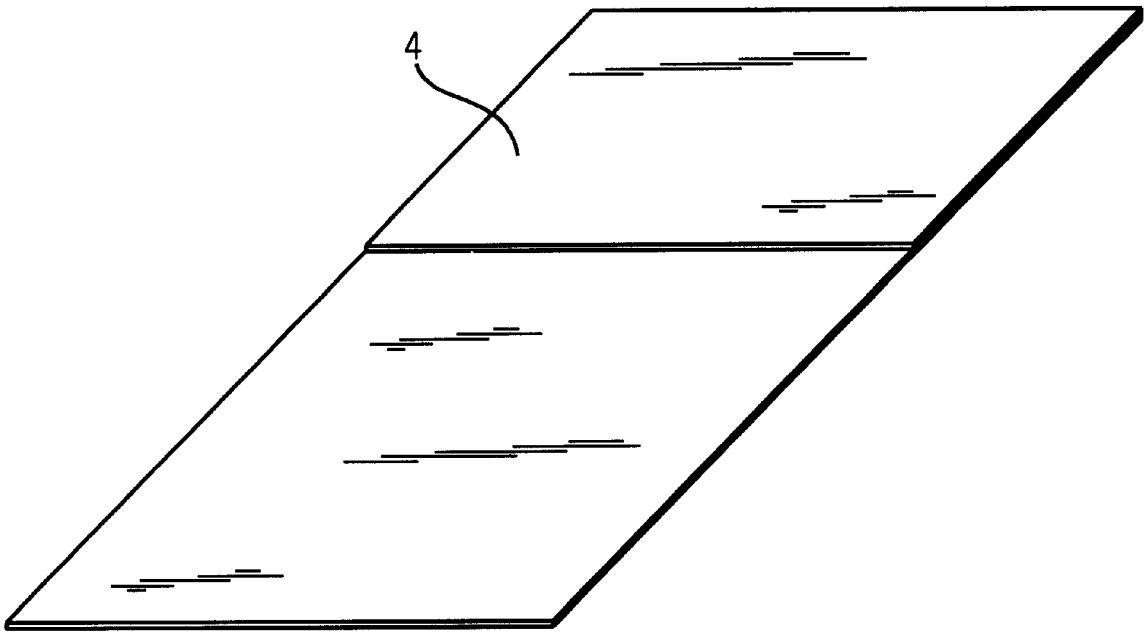
FIG. 10 is a perspective view of the coupon to be dispensed.
Figure 11:
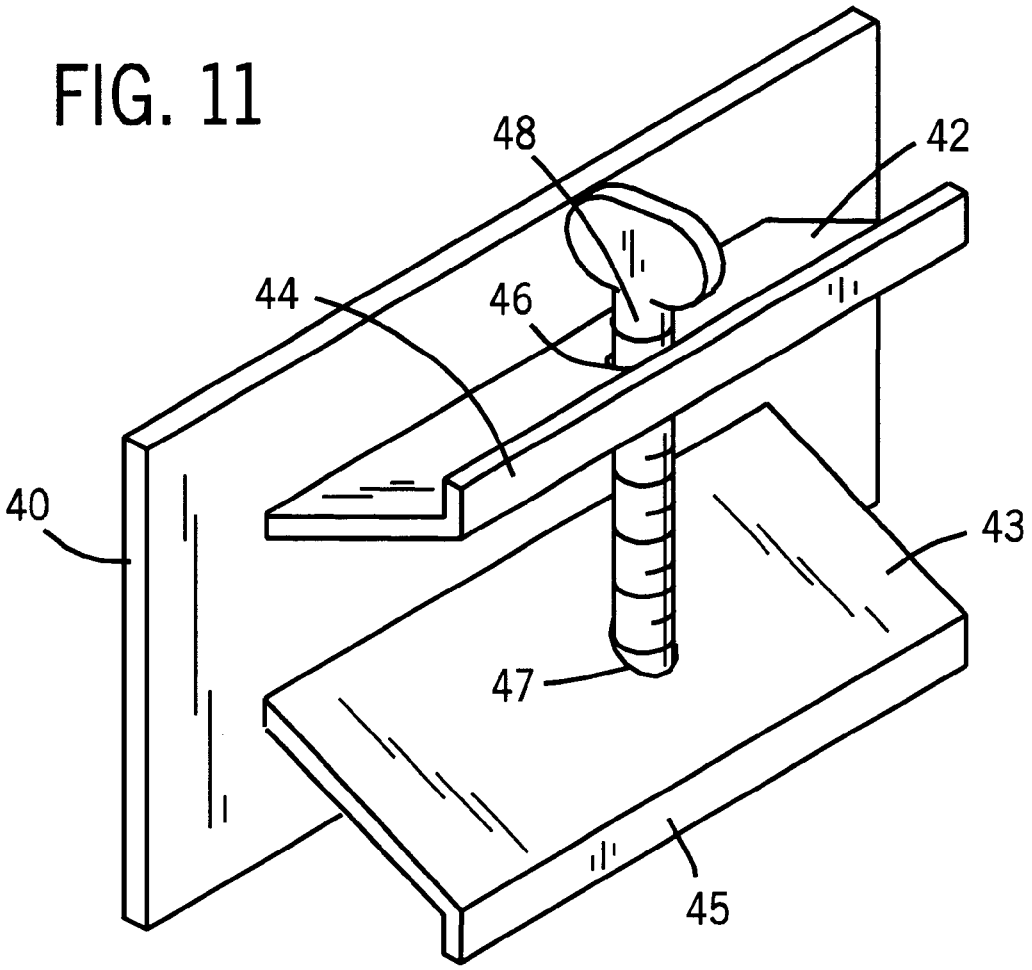
FIG. 11 is a perspective and view of the rail clip attachment.

Referring to FIGS. 1–12, the dispenser 1 comprises a top section 2 having an opening 3 through which coupons or flexible sheets 4 may be dispensed. The dispenser 1, which is generally rectangular or box shaped, 4 has a stack of flexible sheets disposed one on top of another and folded at a specific length, allowing for the dispensing of individual sheets. In a preferred embodiment of the invention, each coupon or flexible sheet 4 is folded upon itself The body of the dispenser is preferably made of one unitary piece of material, cut to allow for folding of the material. Creases are made in the appropriate areas of the material to form edges. The material from which the dispenser is made is either paper, cardboard, styrene or plastic.

The dispenser 1 has two long flat end walls 6 and 10. Edges 11 and 12 of these long flat end walls 6 and 10 are positioned perpendicularly to two long flat side walls 7 and 8. The two long flat end walls 6 are parallel to each other, with each of the two long flat end walls 6 and 10 having the same dimensions as the other flat end wall. The two long flat side walls are preferably wider than the two long flat end walls. The two long flat side walls 7 and 8 are parallel to each other, and the two long flat side walls 7 and 8 parallel to one another.

The walls of the dispenser define an opening 3 through which coupons or sheets may be removed. The opening 3 is formed by opposing foldable flaps 9 formed by an extension from and integral with at least one of the walls, preferably from at least one, and most preferably from both long flat end walls 6 and 10. The foldable flaps 9 positioned at a top end of each of the flat end walls, comprises a lip 15 foldable upon flap 9. In a preferred embodiment, there is at least one tab positioned at each corner of a top end of two long flat side walls, resulting in four tabs 16, 17, 18, and 19 such that each foldable flap of a long flat end wall, folds over two tabs, thereby forming the opening of the dispenser.

The dispenser 1 also has a flat bottom wall 13 wherein at least one edge 14 of the flat bottom wall 13 is affixed to the bottom of the dispenser. The flat bottom wall 13 fits within the dimensions of the two long flat side walls 7 and 8 and the two long flat end walls 6 and 10. In a preferred embodiment, the flat bottom wall 13 has bottom wall flaps 20, 21, 22, and 23 positioned around each side of a flat rectangular section 24. One of the flaps 20, 21, 22, and 23 is integrally connected to one of the walls of the dispenser. Each flap of said bottom wall is positioned against an inside section of each of a wall of said dispenser.

In another a preferred embodiment an insertion tab 25 on one of said walls, preferably on said long flat side wall, fits into a slip opening 26 in one of said flaps 20, 21, 22, and 23 of said bottom wall 13, allowing said long flat side wall 7 or 8, (preferably 8) to secure said bottom wall 13 in position.

In another preferred embodiment of the invention, since the dispenser is comprised of a unitary structure, one of the long flat end walls 6 further comprises an extension integral with the other long flat end wall 10, such that the extension forms one of the long flat side walls 8, and an inside support wall 32 for the other long flat end wall. The inside support wall further comprises a flap 33 integral with the inside support wall, with the flap 33 attachable to one of said one of said long flat side walls 7.

At various other locations in and around the dispenser, the glue or tape may be used to secure the various sides or flap of the dispenser. The opposing flaps 9 and lips 15 glued or taped into position.

A resilient member is used to push the stack of sheets 5 up to the opening 3 in the top wall 2 of the dispenser 1. Any form of spring may be used. In one embodiment of the invention, the member used to push the sheets to the opening 3 of the dispenser is an arc type structure 27 positioned underneath the stack of sheets 5. This arc type structure 27 is positioned between the long flat end walls 6 and 10 and above the flat bottom wall 13. In one embodiment of the invention, one side 29 of the arc type structure is in communication with the bottom of the stack of sheets, wherein the apex 28 of the arc type structure 27 is facing one of the walls of the dispenser, pushing the stack of sheets 5 towards the opening 3 in the dispenser 1. In another embodiment of the invention, the arc type structure 27 may be flexed and inserted between the stack of sheets 5 and the bottom wall 13, such that the apex 28 of the arc type structure is in communication with the stack of sheets.

A filler 30 may be positioned between said resilient member and said bottom wall of said dispenser, thereby putting more stress on the resilient member, which in turns allows the coupons to be dispensed with greater ease. The filler 30 is preferably made of a unitary piece, which folds up to form a small box like structure which fits within the dispenser.

To attract attention, the dispenser may further comprise a specialized advertising tag, known as a shouter 34. The shouter 34 is used to draw attention to the dispenser, and is comprised of a display area for printed matter, known as the head 35, integrally (preferably) attached to a leg 36, wherein one end of the leg is attached to the head, and the other end of the leg is inserted into a slot 37 in the dispenser, allowing for the display of the printed matter. In a preferred embodiment, the shouter further comprises a foot 38, integrally attached to the leg 36 at the end which is inserted into the slot 37 in the dispenser. The foot 38 is a tab which is turned upward, thus serving the purpose of securing the shouter 34 in the dispenser 1. A split 39 in the head 35 from the leg 36 further helps to secure the shouter 34 to the dispenser.

The dispenser 1 is preferably secured to the shelf There are a number of methods to attach the dispenser to the shelf. One method for attaching the dispenser to the shelf is a rail clip attachment 40 for attachment to a rail of a shelf. The rail clip attachment 40 is attached to the flat bottom wall 13 of the dispenser, and comprises a base member 41, two brackets 42, 43 intersecting and extending outwardly from the base member, the brackets having, at their ends, foot-like projections 44, 45 facing away from each other and fitting into retaining rails of a shelf, at least one hole 46, 47 in each of the brackets, and a screw 48, fitted through the holes in the brackets whereupon the tightening or loosening of the screw pushes together or allows for the expansion of the two brackets, thereby allowing for a placement or removal of the device on a shelf edge.

There are many other methods and devices for attaching this dispenser to a shelf or wall. Any of them may be used.

Many modifications and variations of the present invention are possible in light of the above teachings. It is, therefore, to be understood within the scope of the appended claims the invention may be protected otherwise than as specifically described.

What is claimed is:

1. A dispenser for flexible sheets from a stack of sheets disposed one said sheet on top of another, allowing for the dispensing of individual sheets, said dispenser comprising:

walls defining a cavity adapted to receive the stack of said sheets, said walls including:

two long flat end walls parallel to each other; each said long flat end wall having the approximate same dimensions as the other flat end wall;

two long flat side walls wherein edges of each of said two long flat side walls are positioned perpendicularly to edges of the length of said two long flat end walls at opposite sides of said flat top wall, wherein said two long flat side walls are parallel to each other;

a flat bottom wall wherein at least one edge along the length of said flat bottom wall is affixed to the bottom of said dispenser, and wherein said flat bottom wall fits within the dimensions of said two long flat side walls and said two long flat end walls;

a top section comprising an opening through which said coupons may be removed, said opening formed by opposing flaps, said flaps formed by an extension from at least one of said walls;

a resilient member, said resilient member pushing said stack of said sheets to the opening in the top wall of the dispenser, said resilient member positioned underneath said stack of sheets and between said long flat end walls and above said bottom wall, wherein said resilient member is in communication with said stack of sheets, pushing said stack of sheets towards the opening in said top section;

said stack of said sheets being positioned between said two long end walls within said dispenser and wherein each said flexible sheet from said stack of sheets is disposed one said flexible sheet on top of another said flexible sheet, each said flexible sheet being independent from one another and folded upon itself at a specific length, allowing for the dispensing of individual sheets.

2. The dispenser of claim 1, further comprising as structure for directing said stack of said sheets towards the opening in the top wall of the dispenser.

3. The dispenser of claim 1, wherein said dispenser is made of one unitary piece of material, said single piece of flexible material being cut to allow for folding of said material to form said dispenser.

4. The dispenser of claim 1, wherein said dispenser is comprised of a material selected from the group consisting of paper, cardboard, styrene, and plastic.

5. The dispenser of claim 1, further comprising an attachment device for attaching the dispenser to a shelf.

6. The dispenser of claim 5, further comprising a rail clip attachment for attachment to a rail of a shelf, said rail clip attachment be attached to the flat bottom wall of said dispenser.

7. The dispenser of claim 6, said rail clip attachment comprising:

a flat base member for attachment to the the shelf sign;

two brackets intersecting and extending outwardly from the base member, said brackets having, at their ends, foot-like projections facing away from each other, said foot-like projections fitting into retaining rails of a shelf;

at least one hole in at least one of said brackets; and a screw, said is fitted through said hole in one of said bracket, whereupon the tightening or loosening of the screw pushes together or allows for the expansion of the two brackets, thereby allowing for a placement or removal of the device on a shelf edge.

8. The dispenser of claim 1, further comprising a filler positioned between said resilient member and said bottom wall of said dispenser.

9. The dispenser of claim 1, wherein said sheets are coupons.

10. The dispenser of claim 1, wherein said resilient member is an arc type structure, said arc type structure pushing said stack of said sheets to the opening in the top wall of the dispenser, said arc type structure positioned underneath said stack of sheets, said arc type structure positioned between said long flat end walls and above said bottom wall, wherein said arc type structure is in communication with said stack of sheets, pushing said stack of sheets towards the opening in said top section.

11. The dispenser of claim 10, wherein an apex of said arc type structure is in communication with the bottom of said stack of sheets.

12. The dispenser of claim 10, wherein one side of end of said arc type structure is in communication with the bottom of said stack of sheets, wherein said apex of said arc type structure is facing one of said side walls.

13. The dispenser of claim 1, wherein each said sheet of said stack of sheets is independent from one another and folded upon itself at a specific length, allowing for the dispensing of individual sheets.

14. The dispenser of claim 1, further comprising a shouter for drawing attention to the dispenser, said shouter comprising:

a head, said head being a display area for printed matter;

a leg, wherein one end of said leg is attached to said head, and another end of said leg is inserted into a slot in said dispenser, allowing for the display of said printed matter.

15. The dispenser of claim 14, wherein said shouter further comprises a foot, said foot being integrally attached to said leg at the end which is inserted into a slot in said dispenser, said foot being a tab which is turned upward, thus serving the purpose of securing said shouter in said dispenser.

16. The dispenser of claim 1, further comprising a foldable flap on each and integral with said long flat end wall, said foldable flap positioned at a top end of each of said flat end wall, each said foldable flap further comprising a lip foldable upon said flap, and further comprising at least one tab positioned at each corner of a top end of said two long flat side walls, such that each said foldable flap of said long flat end wall, folds over two said tabs, thereby forming said opening of said dispenser.

17. The dispenser of claim 1, wherein one of said long flat end walls further comprises an extension integral with said long flat end wall, said extension forming one of said long flat side walls, and an inside support wall for said other long flat end wall.

18. The dispenser of claim 17, wherein said inside support wall further comprises a flap integral with said inside support wall, said flap attachable to one of said one of said long flat side walls.

19. The dispenser of claim 1, wherein one of said two long flat side walls is shorter than said other long flat side wall.

20. The dispenser of claim 1, wherein said flat bottom wall is integrally attached to one of said side walls.

21. The dispenser of claim 20, wherein said flat bottom wall further comprises flaps positioned around each side of a flat rectangular section, one of said flaps being integrally connected to one of said walls of said dispenser, wherein each said flap of said bottom wall is positioned against an inside section of each of a wall of said dispenser.

22. The dispenser of claim 21, further comprising an insertion tab in said long flat side wall, and a slip opening in one said flap of said bottom wall, allowing said long flat side wall to secure said bottom wall in position.

23. A method for dispensing a sheet from a stack of sheets disposed one top of one another, allowing for the dispensing of individual sheets, comprising:

folding each said sheet upon itself at a specific length, each sheet becoming a flexible folded sheet;

stacking each said flexible folded sheet such that each said flexible folded sheet is stacked one said flexible folded sheet top of another said flexible folded sheet;

inserting said stack of flexible folded sheets into a dispenser, said dispenser comprising:

walls defining a cavity adapted to receive the stack of said sheets, said walls including:

two long flat end walls parallel to each other; each said long flat end wall having the approximate same dimensions as the other flat end wall;

two long flat side walls wherein edges of each of said two long flat side walls are positioned perpendicularly to edges of the length of said two long flat end walls at opposite sides of said flat top wall, wherein said two long flat side walls are parallel to each other;

a flat bottom wall wherein at least one edge along the length of said flat bottom wall is affixed to the bottom of said dispenser, and wherein said flat bottom wall fits within the dimensions of said two long flat side walls and said two long flat end walls;

a top section comprising an opening through which said coupons may be removed, said opening formed by opposing flaps, said flaps formed by an extension from at least one of said walls;

a resilient member, said resilient member pushing said stack of said sheets to the opening in the top wall of the dispenser, said resilient member positioned underneath said stack of sheets and between said long flat end walls and above said bottom wall, wherein said resilient member is in communication with said stack of sheets, pushing said stack of sheets towards the opening in said top section;

said stack of said sheets being positioned between said two long end walls within said dispenser and wherein each said flexible sheet from said stack of sheets is disposed one said flexible sheet on top of another said flexible sheet, each said flexible sheet being independent from one another and folded upon itself at a specific length, allowing for the dispensing of individual sheets, and pulling on a single said folded sheet emerging from the top of said opening in said dispenser, thereupon allowing for the dispensing of the sheet.

24. The method of claim 23, wherein said dispenser is made of one unitary piece of material, from which said dispenser is made, said single piece of flexible material being cut to allow for folding of said material to form said dispenser.

25. The method of claim 23, wherein said dispenser is comprised of a material selected from the group consisting of paper, styrene, and plastic.

26. The method of claim 23, further comprising an attachment device for attaching the dispenser to a shelf.

27. The method of claim 23, further comprising a rail clip attachment for attachment to a rail of a shelf, said rail clip attachment be attached to the flat bottom wall of said dispenser.

28. The method of claim 27, said rail clip attachment comprising:

a flat surface for attachment to the member of the shelf sign;

two brackets intersecting and extending outwardly from the base member, said brackets having, at their ends, foot-like projections facing away from each other, said foot-like projections fitting into retaining rails of a shelf;

at least one hole in at least one of said brackets; and a screw, said is fitted through said hole in one of said bracket, whereupon the tightening or loosening of the screw pushes together or allows for the expansion of the two brackets, thereby allowing for a placement or removal of the device on a shelf edge.

29. The method of claim 23, further comprising a filler positioned between said resilient member and said bottom wall of said dispenser.

30. The method of claim 23, wherein said sheets are coupons.

31. The method of claim 23, wherein said resilient member is an arc type structure, said arc type structure pushing said stack of said sheets to the opening in the top wall of the dispenser, said arc type structure positioned underneath said stack of sheets, said arc type structure positioned between said long flat end walls and above said bottom wall, wherein said arc type structure is in communication with said stack of sheets, pushing said stack of sheets towards the opening in said top section.

32. The method of claim 31, wherein an apex of said arc type structure is in communication with the bottom of said stack of sheets.

33. The method of claim 31, wherein one side of end of said arc type structure is in communication with the bottom of said stack of sheets, wherein said apex of said arc type structure is facing one of said side walls.

34. The method of claim 23, wherein each said sheet of said stack of sheets is independent from one another and folded upon itself at a specific length, allowing for the dispensing of individual sheets.

35. The method of claim 23, further comprising a shouter for drawing attention to the dispenser, said shouter comprising:

a head, said head being a display area for printed matter;

a leg, wherein one end of said leg is attached to said head, and another end of said leg is inserted into a slot in said dispenser, allowing for the display of said printed matter.

36. The method of claim 35, wherein said shouter further comprises a foot, said foot being integrally attached to said leg at the end which is inserted into a slot in said dispenser, said foot being a tab which is turned upward, thus serving the purpose of securing said shouter in said dispenser.

37. The method of claim 23, further comprising a foldable flap on each and integral with said long flat end wall, said foldable flap positioned at a top end of each of said flat end wall, each said foldable flap further comprising a lip foldable upon said flap, and further comprising at least one tab positioned at each corner of a top end of said two long flat side walls, such that each said foldable flap of said long flat end wall, folds over two said tabs, thereby forming said opening of said dispenser.

38. The method of claim 23, wherein one of said long flat end walls further comprises an extension integral with said long flat end wall, said extension forming one of said long flat side walls, and an inside support wall for said other long flat end wall.

39. The method of claim 38, wherein inside support wall further comprises a flap integral with said inside support wall, said flap attachable to one of said one of said long flat side walls.

40. The method of claim 23, wherein one of said two long flat side walls is shorter than said other long flat side wall.

41. The method of claim 23, wherein said flat bottom wall is integrally attached to one of said side walls.

42. The method of claim 41, wherein said flat bottom wall further comprises flaps positioned around each side of a flat rectangular section, one of said flaps being integrally connected to one of said walls of said dispenser, wherein each said flap of said bottom wall is positioned against an inside section of each of a wall of said dispenser.

43. The method of claim 42, further comprising an insertion tab inn said long flat side wall, and a slip opening in one said flap of said bottom wall, allowing said long flat side wall to secure said bottom wall in position.

44. A dispenser for flexible sheets from a stack of sheets disposed one said sheet on top of another, allowing for the dispensing of individual sheets, said dispenser comprising:

walls defining a cavity adapted to receive the stack of said sheets, said walls including;

a top having an opening through which said sheets may be individually dispensed;

two end walls, wherein edges of each of said two end walls are positioned along edges of the width of said top at opposite ends of said top;

two side walls wherein edges of each of said two side walls are positioned along edges of the length of said top at opposite sides of said top;

a bottom wall spaced from said top, wherein at least one edge along the length of said bottom wall is affixed to the bottom of said dispenser;

a resilient flexible arc type structure positioned underneath said stack of sheets pushing said stack of said sheets to the opening in the top of the dispenser, said arc type structure positioned between said end walls and above said bottom wall, wherein said arc type structure is in communication with said stack of sheets, pushing said stack of sheets towards the opening in said top;

said stack of said sheets being positioned between said two end walls within said dispenser and wherein each said flexible sheet from said stack of sheets is disposed one said flexible sheet on top of another said flexible sheet, each said flexible sheet being independent from one another and folded upon itself at a specific length, allowing for the dispensing of individual sheets.

* * * * *